US005293172A

United States Patent [19]

Lamberty et al.

[11] Patent Number: 5,293,172

[45] Date of Patent: Mar. 8, 1994

[54] RECONFIGURATION OF PASSIVE ELEMENTS IN AN ARRAY ANTENNA FOR CONTROLLING ANTENNA PERFORMANCE

[75] Inventors: Bernard J. Lamberty; George S. Andrews, both of Kent; James L. Freeman, Renton, all of Wash.

[73] Assignee: The Boeing Company, Seattle, Wash.

[21] Appl. No.: 953,528

[22] Filed: Sep. 28, 1992

[51] Int. Cl.[5] ..... H01Q 1/26; H01Q 19/30

[52] U.S. Cl. ..... 343/701; 343/815; 343/817; 343/818

[58] Field of Search ..... 343/701, 793, 801, 802, 343/805, 810, 812, 813, 815, 817, 818, 819, 823, 833, 834; H01Q 1/26, 19/30

[56] References Cited

U.S. PATENT DOCUMENTS 4,290,071 9/1981 Fenwick ..... 343/815

*Primary Examiner*—Donald Hajec
*Assistant Examiner*—Hoanganh Le
*Attorney, Agent, or Firm*—Christensen, O'Connor, Johnson & Kindness

[57] ABSTRACT

Disclosed is an array antenna (10) that may be reconfigured to point in multiple directions. The array antenna includes a driven element (12) coupled to a transmission line (14) and a pair of passive elements (22) and (24). The passive elements (22) and (24) each include three antenna segments that are coupled together by a pair of optoelectronic switches (26) and (28), respectively. When the optoelectronic switches coupled to a particular passive element are closed the element functions as a reflector; when the switches are open, the element functions as a director. Other reconfigurable antennas are also disclosed, including antennas with reconfigurable gain and field pattern characteristics.

14 Claims, 9 Drawing Sheets

RECONFIGURATION OF PASSIVE ELEMENTS IN AN ARRAY ANTENNA FOR CONTROLLING ANTENNA PERFORMANCE

FIELD OF THE INVENTION

The invention relates to electromagnetic array antenna systems and, in particular, to reconfigurable array antenna systems controlled through an electromagnetically transparent control source.

BACKGROUND OF THE INVENTION

A number of array antenna applications require the ability to change or reconfigure the electrical performance characteristics of the antenna without the use of extraneous wires that perturb electromagnetic fields in the vicinity of the antenna elements. Typical applications include situations where space or weight are at such a premium that larger, broadband antennas are not practical. Prior attempts to provide reconfigurable array antennas have used electrically-biased diodes to interconnect metal segments of the antenna elements, or have altered the resonant frequency of the antenna elements through either a varactor (voltage controlled capacitor) or current-controlled magnetic devices such as ferrites. In these embodiments, antenna performance is generally seriously degraded because the wires used to bias the diodes, control the varactors, or tune the ferrites intrude into the electromagnetic space occupied by the antenna. Further, these approaches typically require specific array antenna configurations that allowed the bias wires to be incorporated into the antenna elements, thereby increasing the complexity and cost of the antenna.

More recently, optoelectronic switches have been used to reconfigure array antenna elements. Approaches using optoelectronic switches have focused on reconfiguration of the single element of a monopole antenna or, in a multi-element array antenna, on reconfiguration of the active (driven) element of the array antenna. One disadvantage of controlling active or driven antenna elements is that losses associated with switch impedance, especially in the off-state of the antenna, reduce the efficiency of the driven antenna elements, and therefore, of the antenna. The present invention is directed to providing an optically reconfigurable array antenna that avoids the foregoing disadvantages.

SUMMARY OF THE INVENTION

An optically reconfigurable array antenna formed in accordance with the invention provides an antenna beam that may be pointed in any of several directions, including both azimuth and elevation, as well as beams that are adjustable in gain and in pattern shape. The array antenna includes a driven element that is couplable to a transmission line and first and second passive elements that are positioned on opposite sides of the driven element. The first passive element includes at least two co-axially arranged antenna segments and an optoelectronic switch that couples the antenna segments together. The optoelectronic switch has a first, substantially conducting impedance state and a second, substantially non-conducting impedance state. The optoelectronic switch is responsive to an optical activation signal such that the strength of the activation signal determines the impedance state of the switch. The array antenna also includes a non-metallic component for providing an optical activation signal to the optoelectronic switch.

In accordance with further aspects of the invention, the array antenna is a multi-directional antenna. In this aspect, each passive element includes three co-axially aligned antenna segments. An optoelectronic switch couples adjacent pairs of the antenna segments together. When the optoelectronic switches coupled to a passive element are in their first state, the passive element functions as a reflector element; when the switches are in their second state, the passive element functions as a director.

In accordance with other aspects of the invention, the array antenna is multiple-gain antenna wherein a director element is positioned between the first passive element and the driven element. The second passive element is a reflector. When the optoelectronic switch coupling the antenna segments of the first passive element is in its first state, the passive element functions as a director element, thereby increasing the gain of the antenna. When the optoelectronic switch is in its second state, the antenna segments of the first passive element are essentially transparent to the electromagnetic waves of interest and the passive element has little effect on the performance of the antenna.

In accordance with still further aspects of the invention, the components of the array antenna are arranged such that various field patterns may be produced. In this arrangement, the second passive element is a reflector and the first passive element is a tunable director including at least three antenna segments coupled together by a pair of optoelectronic switches. Through manipulation of the optoelectronic switches, the length of the director is changed and hence, the field pattern is also changed. Multiple tunable directors may be used to allow still further changes in the antenna field pattern.

Optoelectronically reconfigurable array antennas in accordance with the invention provide efficiencies over the prior art. For example, without the ability to reconfigure elements, numerous array antennas may be required to allow transmission or reception of signals in more than one direction. Also, using only a single driven element, a user can manipulate the array antenna to change the gain or field pattern of the antenna. While there has been some suggestion of reconfiguring the driven element on an antenna, this approach produces significantly more losses than passive element reconfiguration.

BRIEF DESCRIPTION OF THE DRAWINGS

The foregoing aspects, and many of the attendant advantages of this invention, will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
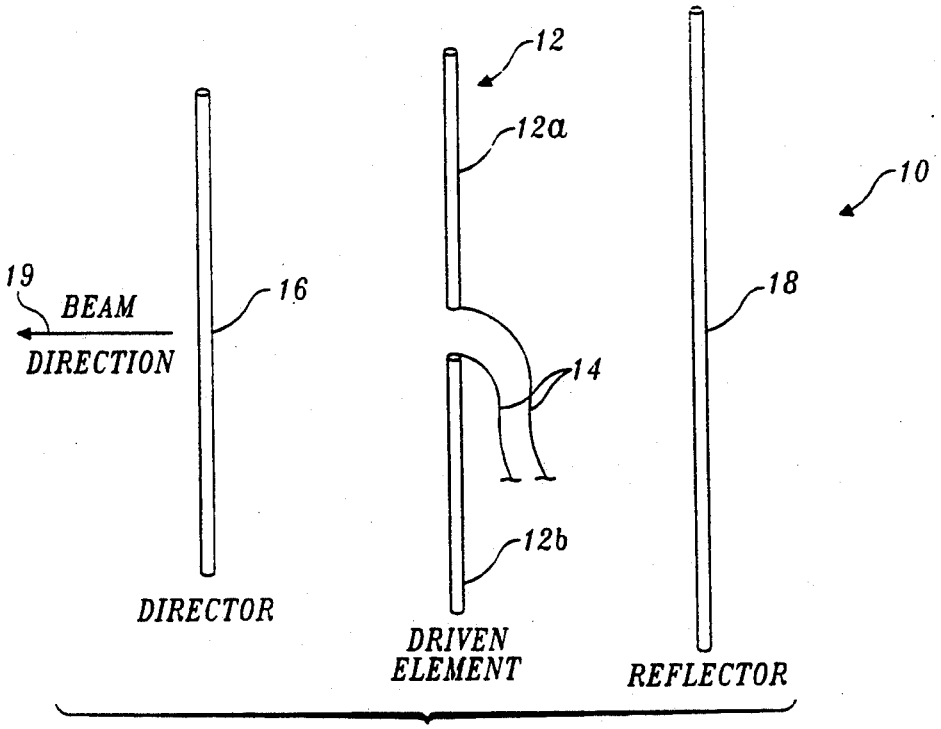
FIG.1. PRIOR ART
FIG. 1 is a pictorial view of a prior art multi-element (Yagi-Uda) antenna including a reflector, director and driven element.

FIG. 1 illustrates a multi-element array antenna 10, commonly referred to as a Yagi-Uda array antenna, that includes a driven element 12, a director element (director) 16 and a reflector element (reflector) 18. The director is shorter in length than the driven element and the reflector is longer in length than the driven element. The driven element includes two antenna segments 12*a* and 12*b* that are coupled to the end of a transmission line 14. The Yagi-Uda array provides greater antenna directivity than, for instance, a monopole antenna, but less bandwidth. As is indicated by an arrow 19, the beam direction for the array antenna 10 is from right to left.

The driven element 12 is considered to be active because it is coupled to an electromagnetic source that drives the antenna or conveys signals received by the antenna to a signal processing device. The director and reflector are passive elements. As is known in the art, the gain of an array antenna can be increased by adding additional director elements arranged in a row on the side of the director 16 opposite the driven element 12. Additional reflector elements may also be added. The gain, input impedance, and bandwidth, as well as other antenna characteristics, are affected by the lengths of the directors and reflectors used in the array antenna.

Figure 2:
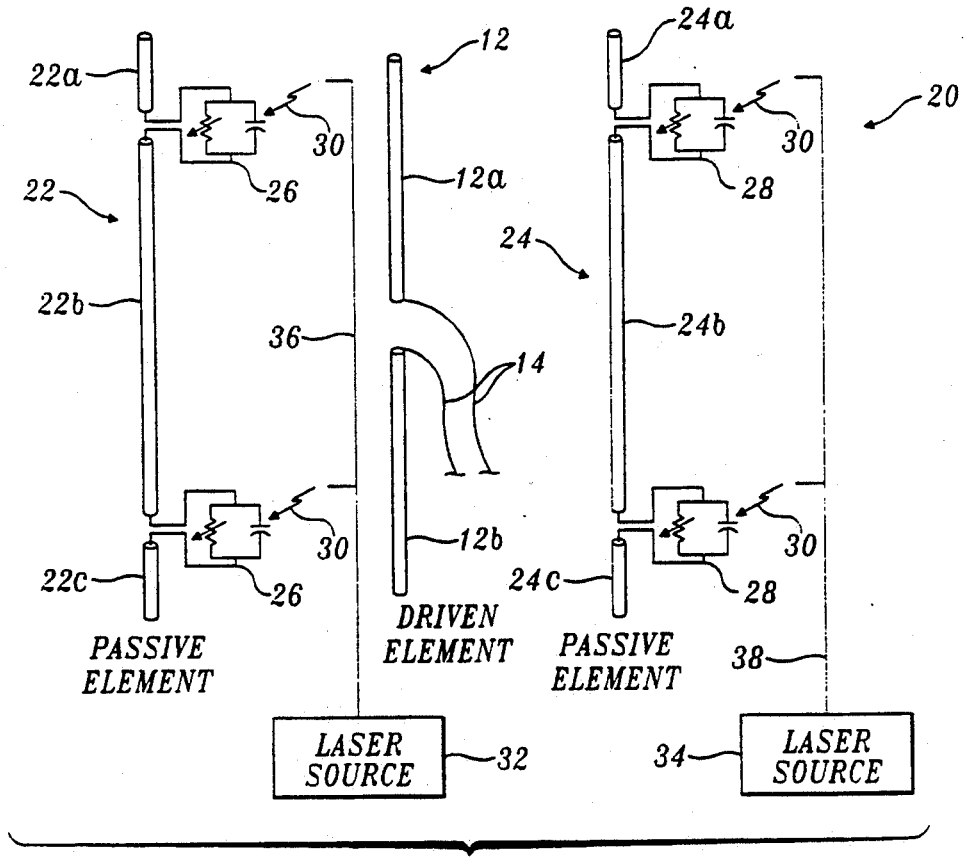
FIG. 2 is a pictorial view of a first exemplary embodiment of an optoelectronically reconfigurable antenna formed in accordance with this invention.

With reference to FIG. 2, an array antenna 20 formed in accordance with the invention is reconfigurable to have its beam direction point either left-to-right or right-to-left while utilizing a common driven element 12 coupled to a transmission line 14. This is accomplished through a pair of linear passive antenna elements 22 and 24 that are configured to be a director and reflector, respectively, when the beam is directed to the left; and a reflector and director, respectively, when the beam is directed to the right. Each passive element 22 and 24 includes three co-axial antenna segments that are coupled together end-to-end by a pair of optoelectronic switches. Passive element 22 includes antenna segments 22*a*, 22*b*, and 22*c*, which are coupled together by a pair of optoelectronic switches 26; and passive element 24 includes antenna segments 24*a*, 24*b*, and 24*c*, which are coupled together by a pair of optoelectronic switches 28.

The optoelectronic switches 26 and 28 operate, in effect, as single-pole, single-throw switches. In this regard, a high impedance is presented between the antenna segments when the switches are in one switching state, for example, not illuminated. On the other hand, a low impedance path is presented between the antenna segments when the switches are in a second switching state, for example, illuminated. A suitable optoelectronic switch is disclosed in Freeman, et al., Microwave Control Using a High-Gain Bias-Free Optoelectronic Switch, Optical Technology For Microwave Applications V, S. Yao, editor, *Proc. SPIE* Vol. 1476, pp. 320–25 (1991), which is hereby incorporated by reference. Another suitable switch is disclosed in U.S. application Ser. No. 07/768,836, entitled Microwave Optoelectronic Switch, filed Sep. 30, 1991 and commonly owned by the assignee of this application, which is also incorporated by reference. Other optoelectronic switches that may be used are also available and will be apparent to those skilled in switching technologies upon understanding the disclosed invention.

The optoelectronic switches are activated by an optical control signal that is generally represented by reference numeral 30. In a preferred embodiment, the optical control signals 30 are provided by laser sources 32 and 34 and carried through electromagnetically transparent optical fiber cables 36 and 38, respectively. Further, it is assumed that in this embodiment illumination closes an optoelectronic switch, although the opposite may most certainly be implemented. Excitation of the laser source 32 causes the optoelectronic switches 26 to conduct, thereby effectively increasing the length of passive element 22 by electrically connecting the antenna segments 22*a*, 22*b*, and 22*c* together. The increased length of passive element 22 makes passive element 22 a reflector. In this case, the optoelectronic switches 28 are not illuminated. As a result, the antenna element 24 will function as a director because only the center segment 24*b* is functional. Antenna segments 24*a* and 24*c* will have a negligible affect on the performance of the array antenna 20, and on the performance of the antenna segment 24*b* in particular, because the antenna segments 24*a* and 24*c* will be virtually transparent to electromagnetic signals of interest due to the high impedance created by nonconducting optoelectronic switches 28. Thus, the beam direction of the array antenna will be to the right.

In a configuration opposite that described above, illumination of the optoelectronic switches 28 causes passive element 24 to act as a reflector, and the absence of illumination of the optoelectronic switches 26 causes passive element 22 to act as a director. Thus, the antenna beam is directed to the left.

Because the array antenna 20 illustrated in FIG. 2 is reconfigurable, it can be directed to point in different directions or angles simply by changing the characteristics of the passive antenna elements in the array. This approach is more efficient than prior systems that have required a number of sets of array antennas, each having its own driven element, to provide the capability of scanning or receiving in multiple directions.

Efficiency stemming from the invention is, in part, due to the use of a single driven element while still providing the ability to reconfigure the antenna. Further, efficiency is due to the reconfiguration of passive elements, rather than driven elements. Efficiency is improved because current levels in the passive elements are significantly less than current levels in the driven elements of the antenna. It has been found that in a typical Yagi-Uda array antenna having a single driven element, the current levels in the director element(s) are as little as one-half that of the driven element and, in the reflector element(s), as little as one-fourth that of the driven element. Since losses are proportional to the square of the level of current flowing through a medium, the losses associated with adding optoelectronic switches to an array antenna are reduced by up to a factor of four when the switches are added to director elements and a factor of sixteen when the switches are added to the reflector elements, in contrast to losses that would occur if the optoelectronic switches were added to the driven element. Thus, the configuration of FIG. 2 is an extremely efficient way of providing reconfigurable antennas that do not perturb the electromagnetic fields around the antennas.

Figure 3:
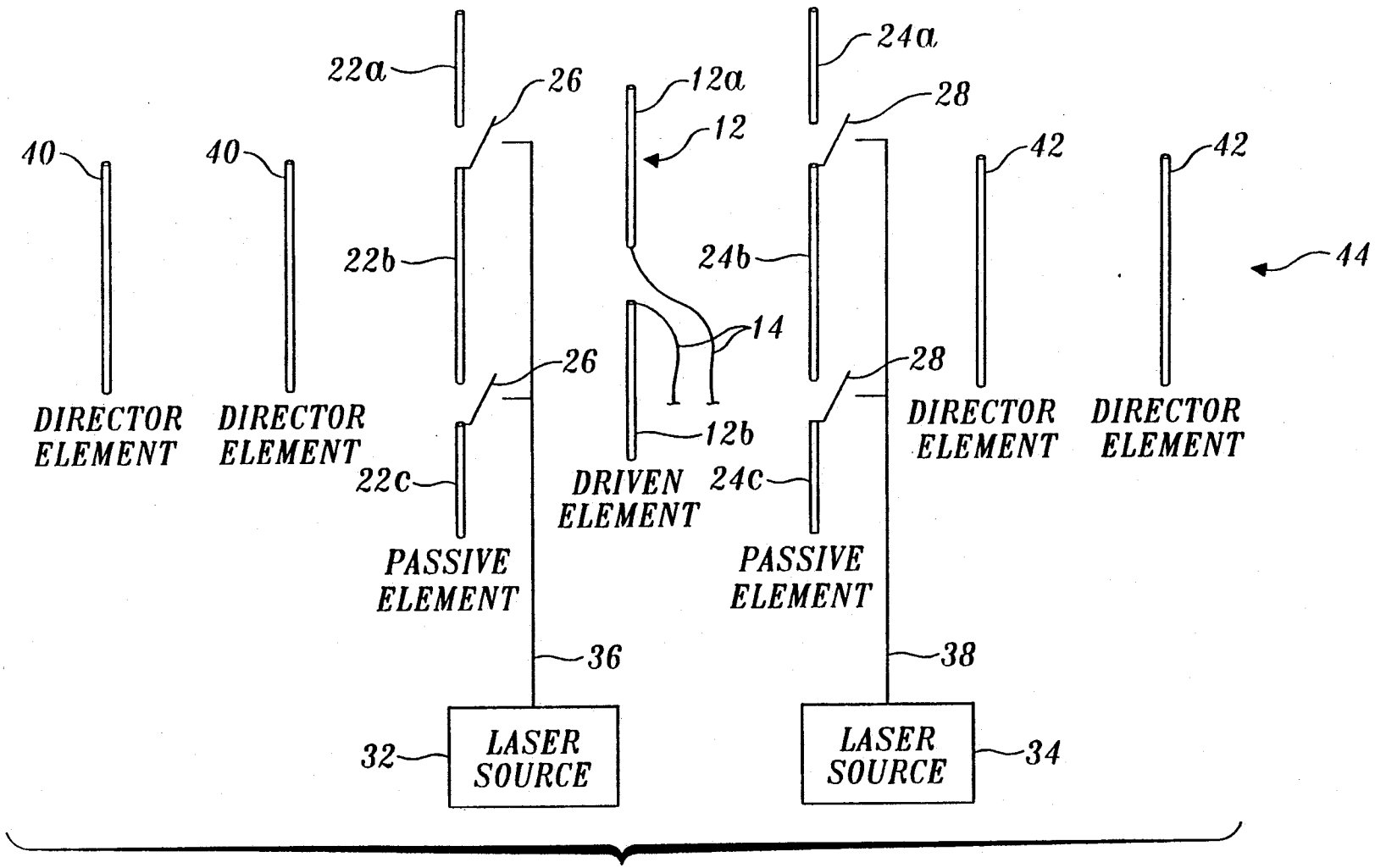
FIG. 3 is a pictorial view of a second exemplary embodiment of an optoelectronically reconfigurable antenna formed in accordance with this invention.

It is known that additional director elements may be added to Yagi-Uda array antennas (such as that shown in FIG. 1) to increase the gain of the antenna. See H. Jasik, *Antenna Engineering Handbook*, § 5.6 (1961). FIG. 3 illustrates the addition of pairs of director elements 40 and 42 to the array antenna 20 of FIG. 2, thereby forming an array antenna 44 having increased antenna gain with a somewhat narrower beam width. The director elements 40 and 42 are located on the left and right, respectively, of the array antenna 44. To direct the array antenna 44 to the left, the optoelectronic switches 28 are closed. Hence, the director elements 40 increase the gain of the antenna in that direction. It is noted that when the array antenna 44 is configured to point left, the effective length of passive element 24 (functioning as a reflector) will essentially isolate the director elements 42, thereby minimizing their effect on the performance of the array antenna.

When the array antenna 44 is directed to the right, the director elements 42 increase the gain of the antenna. In this case, the effective length of passive element 22 will essentially isolate director elements 40 from the array antenna. As will be appreciated, additional director elements may be added to the array antenna to further increase the gain of the antenna. Also, a single additional director element may be implemented rather than the pairs of director elements as shown in FIG. 3. Finally, it is noted that for optimal antenna performance the director elements 40 and 42 should be approximately the same length as the center segments **22*b* and 24*b* of the antenna elements 22 and 24**.

As will be appreciated from the following, the array antennas of FIGS. 2 and 3 may be extended to provide directivity in a plurality of additional directions while still utilizing a single driven element 12 and transmission line 14. FIGS. 4A–4D illustrate an array antenna 50 that may be directed in any of four orthogonal directions along a two-dimensional (x-y) coordinate system, including 0° (positive x coordinate to the right), 90° (positive y coordinate), 180° (negative x coordinate to the left), and 270° (negative y coordinate). In looking more particularly at FIGS. 4A–4D, the direction of the array antenna is illustrated by the dashed rectangles 52 in each of the figures.

The array antenna 50 includes four passive elements 54, 56, 58, and 60, each of which is divided into three antenna segments, with the antenna segments of the elements being coupled together by sets of optoelectronic switches 62, 64, 66, and 68, respectively. The array antenna 50 further includes a plurality of optional director elements, all of which are generally labeled with reference numeral 70. As in FIGS. 2 and 3, the optoelectronic switches are controlled through a plurality of laser sources (not shown) via electromagnetically transparent cables (also not shown). Preferably, the optoelectronic switches present a low impedance path across the antenna segments when illuminated by light from the laser sources, and a high impedance path otherwise.

In each of the FIGS. 4A–4D, a single set of the optoelectronic switches 62, 64, 66, and 68 is open and the remaining sets are closed, i.e., illuminated. In this manner, one of the passive elements 54, 56, 58 and 60 will function as a director element and the remaining elements will function as reflector elements. The direction of the antenna beam will be away from the reflector elements and toward the director element. More particularly, in FIG. 4A, the optoelectronic switches 64, 66, and 68, corresponding to the passive elements 56, 58 and 60, are closed. Thus, these elements are configured as reflectors. The remaining optoelectronic switch 62 is open such that the central segment of the passive element 54 is a director element, and the antenna pointed to the right or at 0°, as is indicated by the rectangle 52. As is discussed above with reference to FIG. 3, the passive elements that are configured as reflector elements will essentially isolate the adjacent director elements 70, i.e., those outside of the rectangle 52. Thus, these direction elements will have little effect on the performance of the antenna.

Figure 4A:
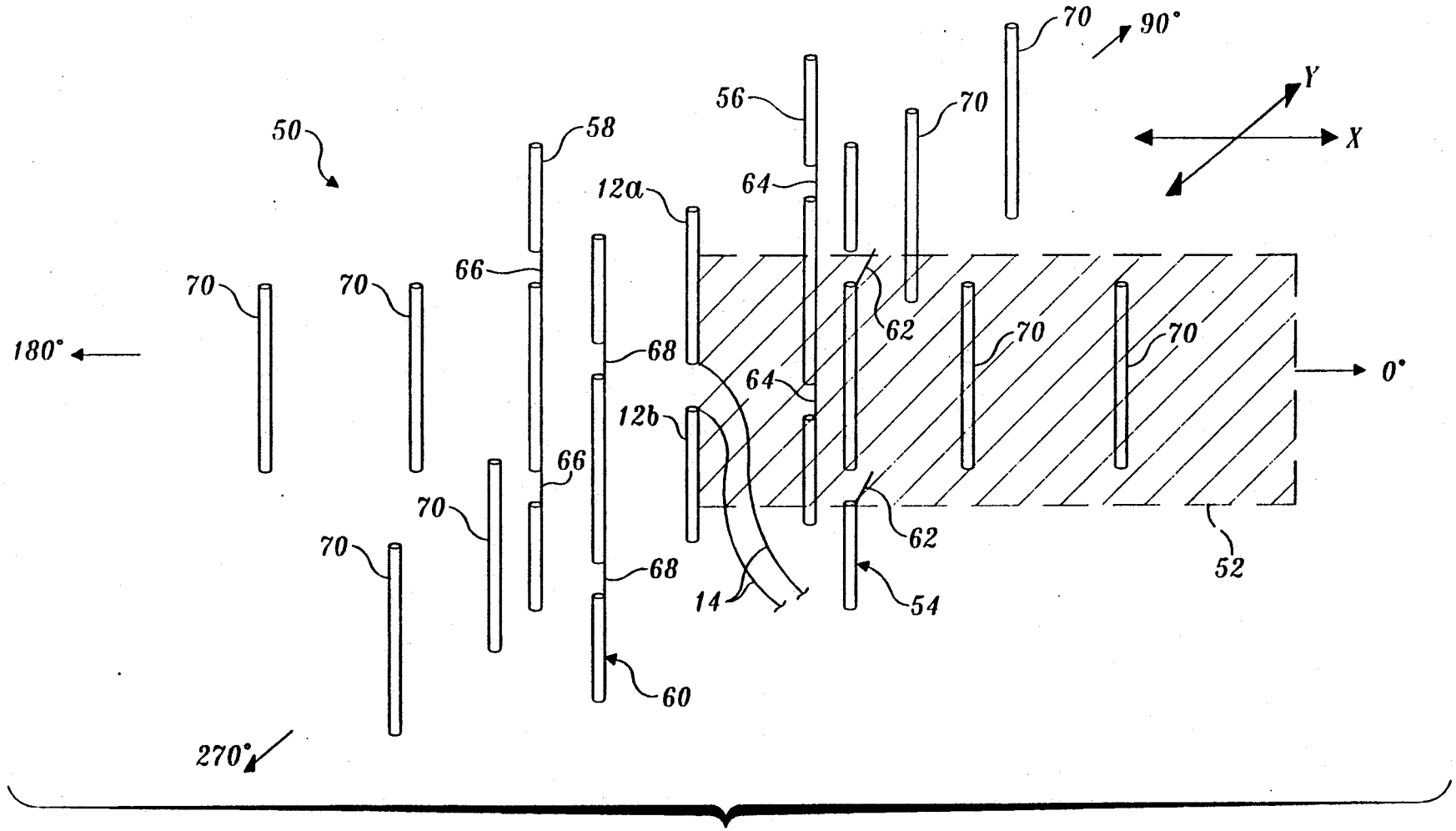
FIG. 4A is a pictorial view of a third exemplary embodiment of an optoelectronically reconfigurable antenna formed in accordance with this invention and in which the antenna is configured to point at 0° (to the right)
Figure 4B:
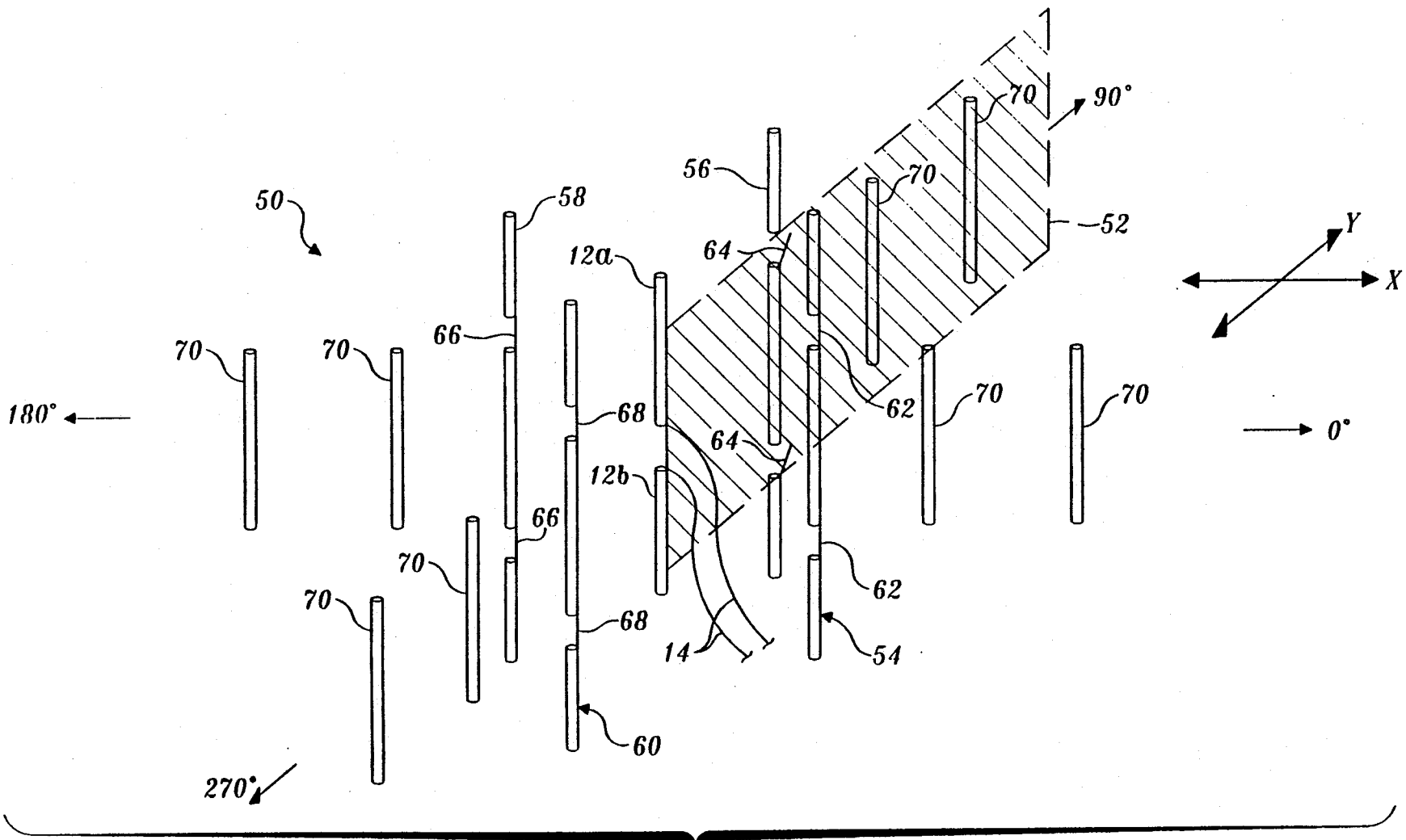
FIG. 4B is a pictorial view of the optoelectronically reconfigurable antenna of FIG. 4A in which the antenna is configured to point at 90° (positive y coordinates)
Figure 4C:
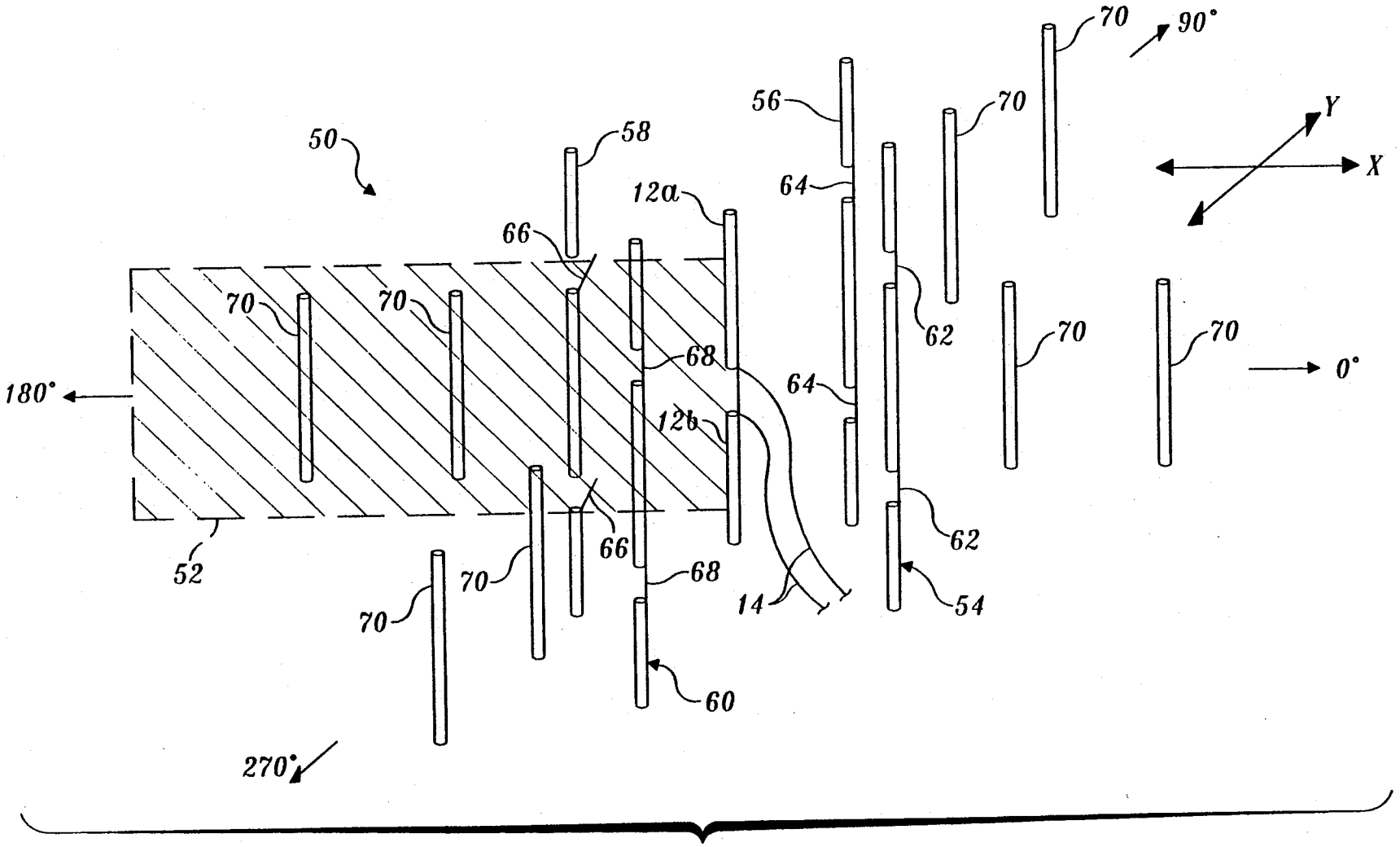
FIG. 4C is a pictorial view of the optoelectronically reconfigurable antenna of FIG. 4A in which the antenna is configured to point at 180° (to the left)
Figure 4D:
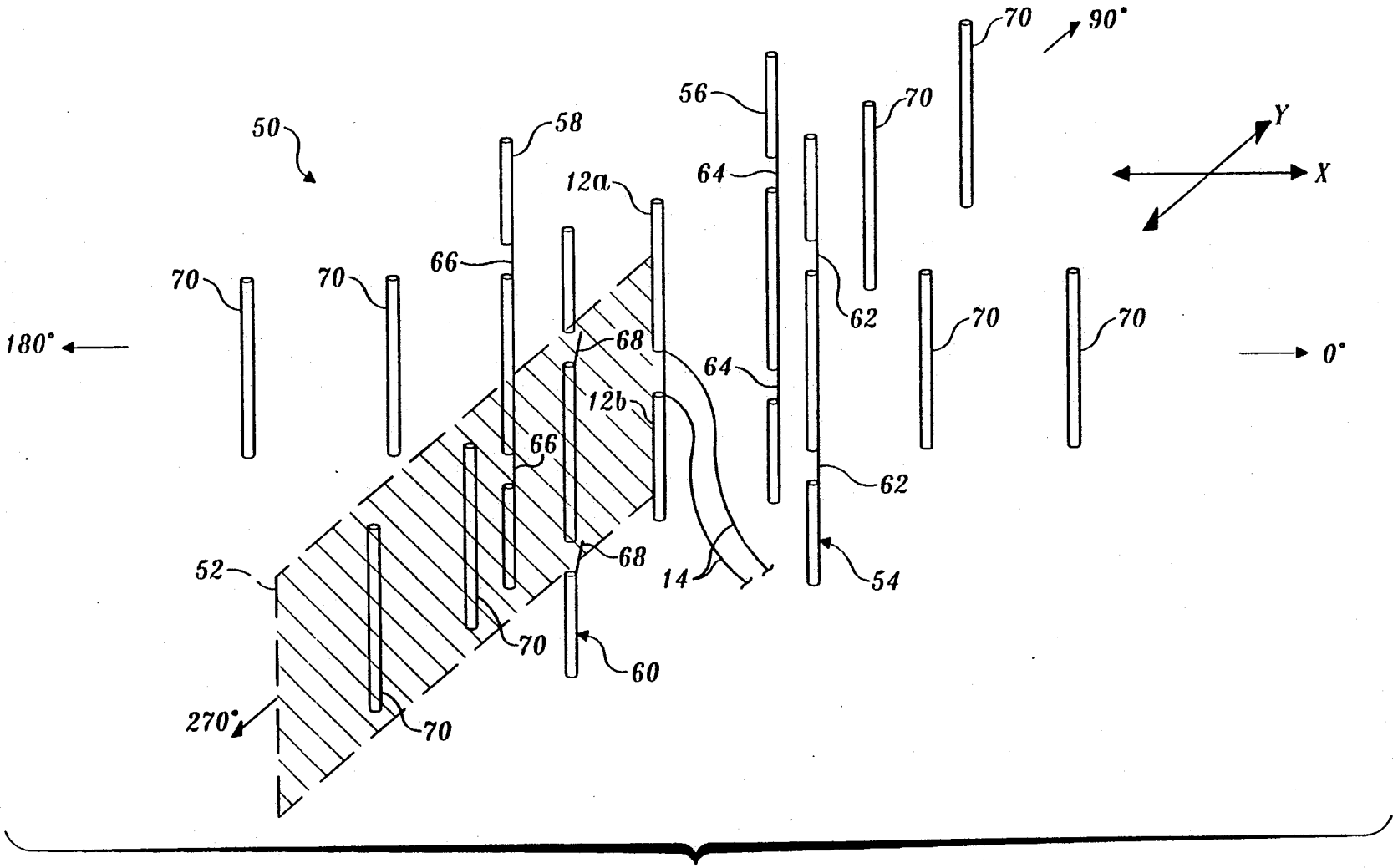
FIG. 4D is a pictorial view of the optoelectronically reconfigurable antenna of FIG. 4A in which the antenna is configured to point at 270° (negative y coordinates)

The configuration of optoelectronic switches in FIGS. 4B–4D follows the same logic as that in FIG. 4A, with the optoelectronic switches in the desired beam direction left open and the remaining optoelectronic switches being closed. In FIG. 4B, the direction of the array antenna 50 is 90°, in FIG. 4C the direction is 180°, and in FIG. 4D the direction is 270°. The array antenna 50 is very advantageous in that by manipulating the optoelectronic switches the beam of the array antenna can be scanned in any one of four orthogonal directions. Only one driven element is required. The configuration and performance of the driven element remains constant and is independent of the beam scan direction. The director elements 70 provide greater antenna gain and are optional. It is noted that a different number of director elements 70 (than those shown in FIGS. 4A–4D) may be implemented in any of the four directions of the beam scan to increase or decrease the antenna gain. Further, from the foregoing, it will also be appreciated that additional passive elements may be added to the array antenna 50 to increase the number of beam directions available for the single driven element 12. There are, however, practical limits to the number of scan angles that may be implemented from a single driven element, due to coupling between passive elements that may occur when the elements are in the field of view of the antenna beam. Such passive elements will tend to degrade performance of the desired antenna beam by directing energy into undesired angular directions.

Figure 5:
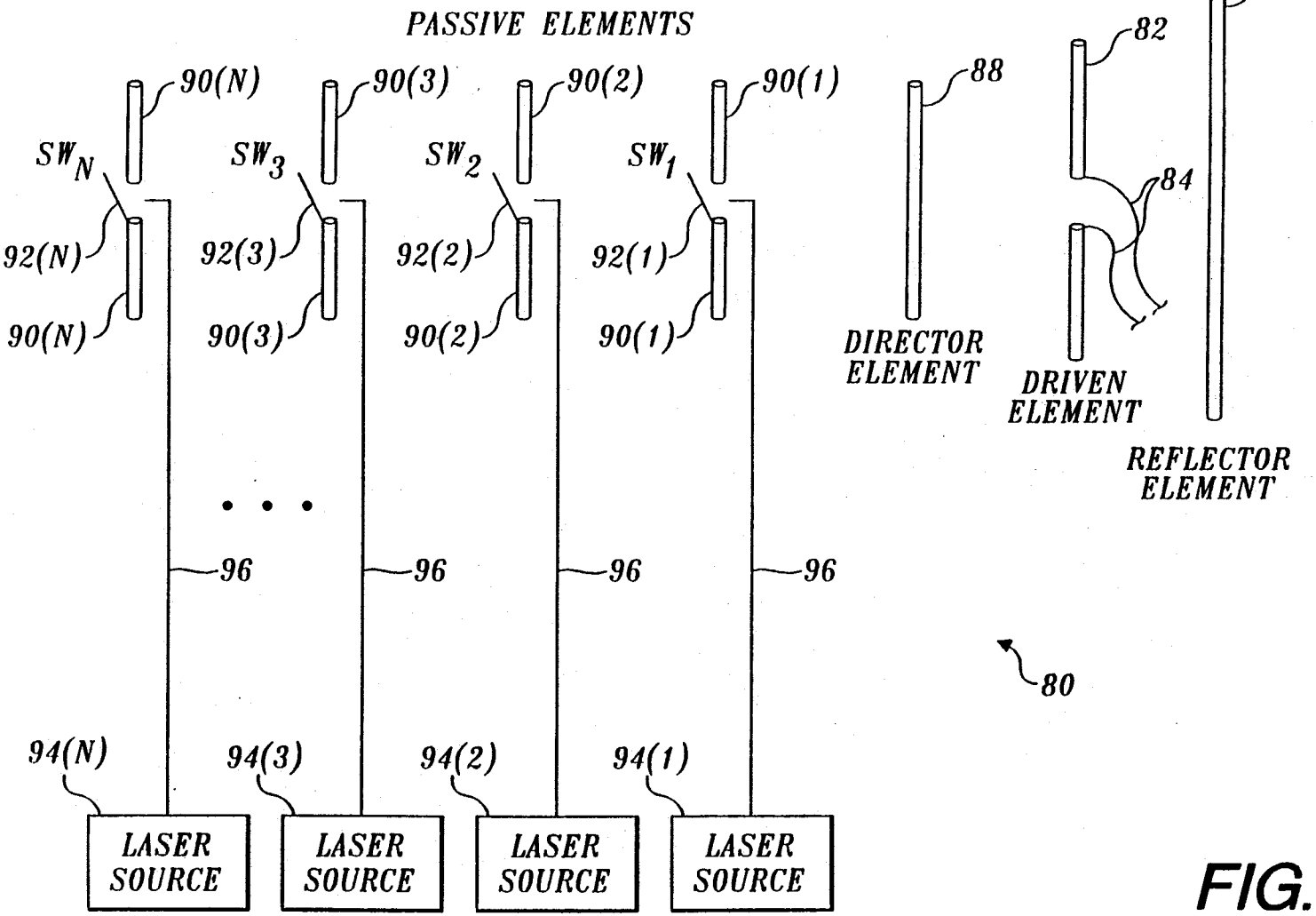
FIG. 5 is a pictorial view of a fourth exemplary embodiment of an optoelectronically reconfigurable antenna formed in accordance with this invention in which the gain of the antenna may be selectively increased or decreased by closing or opening, respectively, optoelectronic switches coupled to passive director elements of the antenna.

FIG. 5 illustrates a means for reconfiguring a Yagi-Uda array antenna to exhibit various gain and beam width characteristics. As with any prior art Yagi-Uda array antenna, an array antenna 80 in accordance with the invention includes a driven element 82 coupled to the end of a transmission line 84, a reflector element 86, and a director element 88. Varying gain and beam width capabilities are added to the array antenna by a number of passive elements 90(1), 90(2), . . . 90(N) that are located in a row on the side of the director element 88, opposite the driven element 82. The passive elements 90(1), 90(2), . . . 90(N) are each separated into two substantially equal antenna segments by optoelectronic switches 92(1), 92(2), . . . 92(N). The optoelectronic switches 92 are each optically coupled to a laser source 94(1), 94(2), . . . 94(N) via electromagnetically transparent cables 96. The gain of the array antenna 80 is controlled by sequentially turning the laser sources 94 on and off.

In operation, when the optoelectronic switch 92 of one of the passive elements 90 is closed, the antenna segments comprising the element are effectively short circuited. As a result, element 90 functions as a director. In contrast, when the optoelectronic switch 92 is open, the antenna segments are separated by the relatively high impedance of the switch, causing the antenna segments to be essentially invisible to the array antenna.

In one embodiment of the invention, the optoelectronic switches are configured to be open unless illuminated by one of the laser sources 94. The gain of the array antenna 80 is increased by sequentially activating the laser sources starting with the first laser source 94(I) and ending with the last laser source 94(N). Thus, if the first laser source 94(1) is on and the remaining laser sources are off, the array antenna 80 consists of a driven element, a reflector element, and two director elements. Activation of the adjacent laser source 94(2) provides a third director, activation of the next adjacent laser source 94(3) provide a fourth director and so on. When all N of the laser sources 94 are on, the array antenna 80 consists of a driven element, a reflector element and (N+1) director elements. In the configuration where three of the laser sources 94(1), 94(2) and 94(3) are all on, the antenna gain is typically more than twice the gain exhibited when only the first laser source 94(1) is on.

Figure 6:
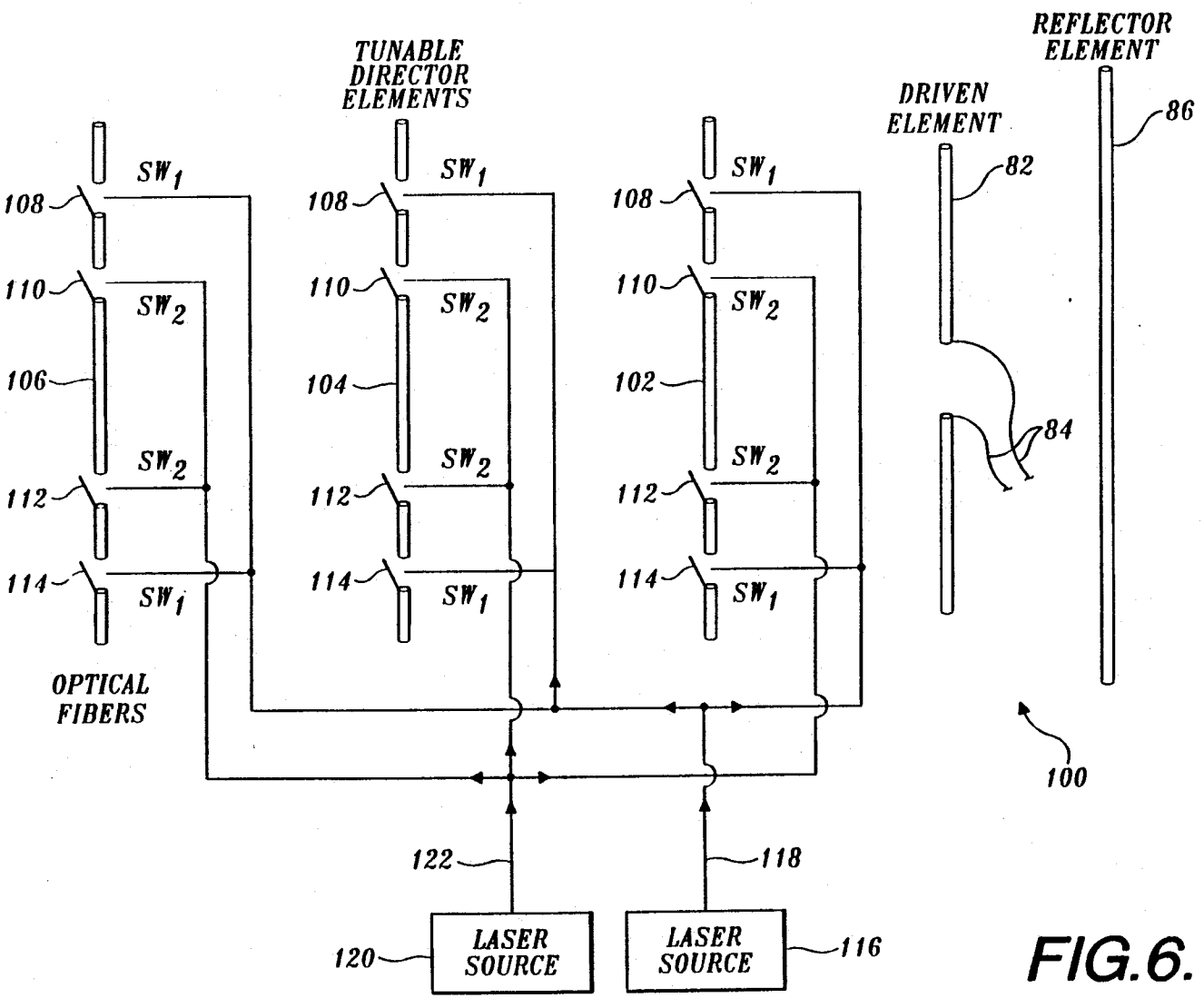
FIG. 6 is a pictorial view of a fifth exemplary embodiment of an optoelectronically reconfigurable antenna formed in accordance with this invention, including a number of director elements that are tunable in length to vary the field pattern of the antenna.
Figure 7:
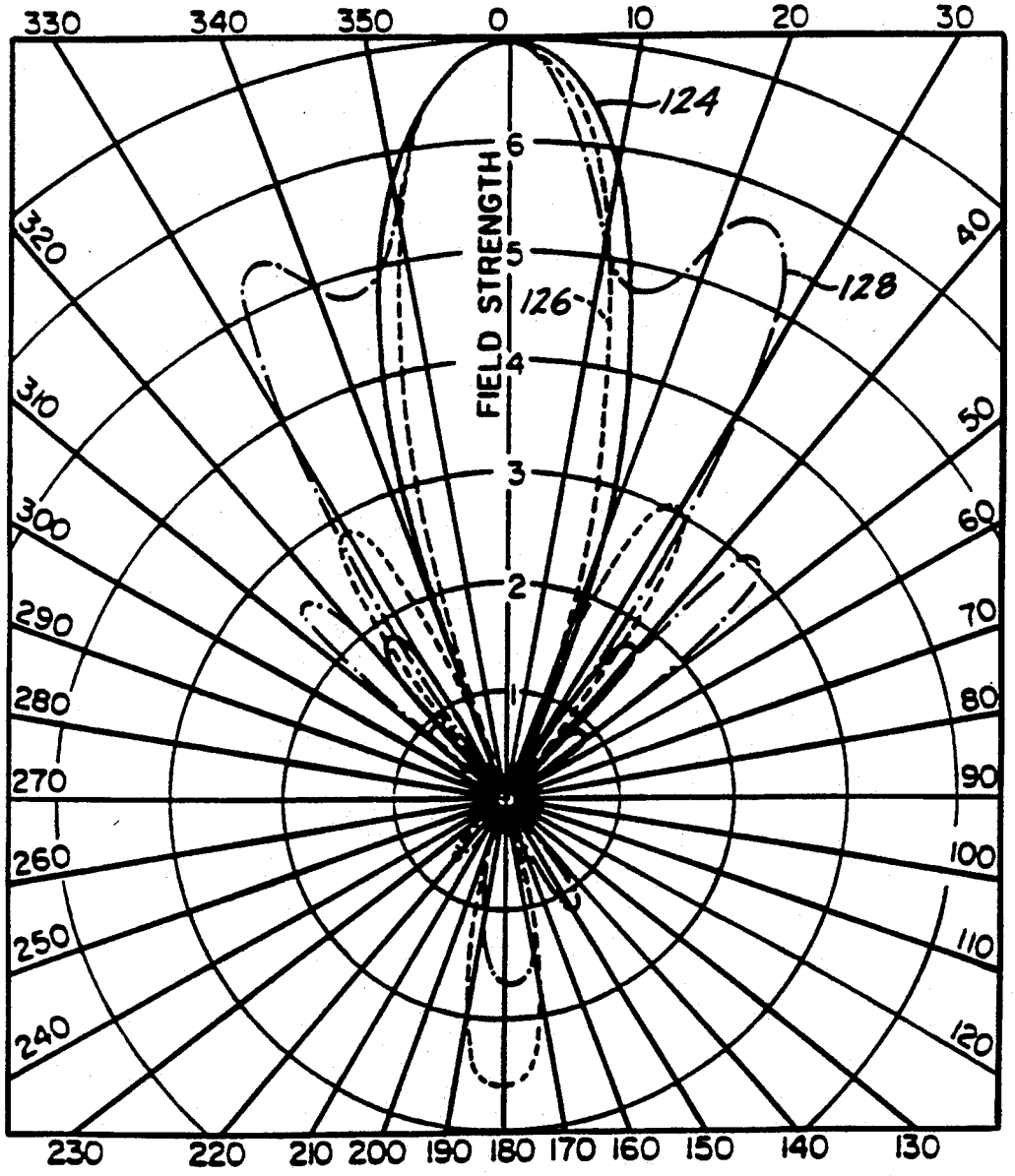
FIG. 7 illustrates three exemplary antenna patterns that are produced when director elements of three different lengths are substituted in a prior art Yagi-Uda array having thirteen (13) directors.

With reference to FIGS. 6 and 7, it is known that the field pattern of a Yagi-Uda array antenna is dependent upon the length(s) of the director element(s) comprising the array. This stems from the property that the field pattern of an antenna is created through the radiation characteristics of currents propagating across the director elements. Changing the lengths of the directors changes the current distributions and thus, the radiation characteristics. FIG. 6 illustrates an array antenna 100 that includes three director elements 102, 104 and 106 that are tunable in length, using optoelectronic switches, such that the field pattern of the antenna may be varied in accordance with the invention. A driven element 82, transmission line 84 and reflector element 86 are also illustrated. Each of the director elements 102, 104, and 106 includes five segments joined by four optoelectronic switches 108, 110, 112 and 114. The two optoelectronic switches that join the outer segments to the next inward segments of each director element 108 and 114 are coupled to a first laser source 116 via an optical cable 118. The optoelectronic switches that join the mid segment to the next outer segments 110 and 112 are coupled to a second laser source 120 via an optical cable 122.

A typical example of the changing field patterns that result from varying the lengths of the director elements of an array antenna is illustrated in FIG. 7. This example is taken from H. Jasik, *Antenna Engineering Handbook* § 5.6 (1961). The antennas used to produce these patterns were 13-director Yagi-Uda array antennas having director lengths of 0.408λ (wavelength) in pattern 124, 0.43λ in pattern 126 and 0.44λ in pattern 128.

The following discussion assumes that the optoelectronic switches are closed when illuminated by the laser sources and open otherwise. When both laser sources 116 and 120 are off, the director elements 102, 104 and 106 have their shortest length since the direction elements are limited to the length of the mid segment. In this instance, the antenna pattern may resemble the pattern 124 depicted in FIG. 7. Activation of laser source 120 effectively lengthens each of the director elements to the total length of the mid segment and the next outer segments. Such an arrangement creates an antenna pattern that may resemble pattern 126 in FIG. 7. Activation of both laser sources further lengthens each of the director elements 102, 104 and 106; the resulting pattern for this change may resemble the pattern indicated by reference numeral 128. Thus, as can be seen, the array antenna 100 can be set up to accommodate a number of applications. An antenna, such as array antenna 100, having reconfigurable elements to vary the field pattern of the antenna is desirable in applications that in one instance require high gain with relatively narrow angular coverage and in another require a wider angular coverage at the expense of lower gain. Accommodation of any given application is simply a matter of changing the states of the optoelectronic switches coupled to the directors of the antenna.

It is noted that other optoelectronic switch combinations may be used to produce additional array antenna configurations. For example, closing only the optoelectronic switches 108 and 110 on the upper end of the antenna elements produces an antenna beam that tilts upwardly. In contrast, closing only the optoelectronic switches 112 and 114 on the lower end of the antenna elements produces an antenna beam that tilts downwardly. Alternating the optoelectronic switch sequence produces sequential lobing in elevation. This is a useful way of accomplishing elevation direction finding.

As will be appreciated by those skilled in the art various antenna configurations (other than those explicitly disclosed herein) may be implemented by placing optically reconfigurable passive elements in other ways around a driven element of an array antenna. Such configurations will produce beams that may be pointed in any of several directions, including both azimuth and elevation, as well as beams that are adjustable in gain and in pattern shape. It will also be appreciated that the antenna configurations disclosed in accordance with the invention will exhibit virtually the same gain, radiation pattern, and impedance characteristics irrespective of whether the antennas are used for transmission or reception. Finally, it is noted that the configurations set forth in FIGS. 2–6, and the accompanying text are merely exemplary in nature. Thus, while preferred embodiments of the invention have been illustrated and described, it will be appreciated that various changes can be made therein without departing from the spirit and scope of the invention.

The embodiments of the invention in which an exclusive property or privilege is claimed are defined as follows:

1. An optically reconfigurable array antenna, comprising:

(a) a driven element that is couplable to a transmission line;

(b) first and second passive elements positioned on opposite sides of the driven element, the first passive element including at least two co-axially arranged antenna segments and an optoelectronic switch that couples the antenna segments together, the optoelectronic switch having a first, substantially conducting impedance state and a second, substantially non-conducting impedance state, the optoelectronic switch being responsive to an optical activation signal such that the strength of the activation signal determines the impedance state of the optoelectronic switch; and (c) non-metallic means for providing an optical activation signal to the optoelectronic switch.

2. The optically reconfigurable array antenna of claim 1 wherein the array antenna is a multi-directional array antenna.

3. The optically reconfigurable array antenna of claim 2 wherein the first and second passive elements each include three antenna segments arranged co-axially, with pairs of the antenna segments of each passive element being coupled together by an optoelectronic switch having a first, substantially conducting impedance state and a second, substantially non-conducting impedance state, the optoelectronic switch being responsive to an optical activation signal such that the strength of the activation signal determines the impedance state of the optoelectronic switch.

4. The multi-directional array antenna of claim 3 wherein when the optoelectronic switches coupled to one of the passive elements are in their first state, the respective passive element functions as a reflector element and when in their second state, the respective passive element functions as a director element.

5. The optically reconfigurable array antenna of claim 1 wherein the second passive element is a reflector element and the array antenna further includes a director element positioned between the driven element and first passive element.

6. The optically reconfigurable array antenna of claim 5 wherein the gain of the array antenna is dependent upon the state of the optoelectronic switch.

7. The optically reconfigurable array antenna of claim 6 wherein when the optoelectronic switch is in its first impedance state the array antenna has a higher gain than when the optoelectronic switch is in its second impedance state.

8. The optically reconfigurable array antenna of claim 6 further including a third passive element positioned adjacent the first passive element, opposite the driven element, the third passive element including two co-axially arranged antenna segments and an optoelectronic switch coupled between the antenna segments such that closing the optoelectronic switch increases the gain of the array antenna.

9. A multi-directional array antenna, comprising:

(a) a driven element that is couplable to a transmission line;

(b) a pair of passive elements disposed on each side of the driven element, each passive element having at least three coaxially arranged antenna segments;

(c) a plurality of optoelectronic switches, a different one of the optoelectronic switches being coupled between adjacent pairs of the antenna segments of each passive element, each optoelectronic switch having a first, substantially conducting impedance state and a second, substantially non-conducting impedance state, the optoelectronic switches being responsive to an optical activation signal such that the strength of the activation signal determines the impedance state of the optoelectronic switch; and (d) non-metallic means for providing an optical activation signal to the optoelectronic switches.

10. The multi-directional array antenna of claim 9 and further including a director element positioned adjacent each passive element, opposite the driven element.

11. The multi-directional array antenna of claim 9 wherein when the optoelectronic switches coupled to one of the passive elements are in their first state, the respective passive element functions as a reflector element.

12. The multi-directional array antenna of claim 11 wherein when the optoelectronic switches coupled to one of the passive elements are in their second state, the respective passive element functions as a director element.

13. An array antenna having a plurality of scan angles, comprising:

(a) a driven element that is couplable to a transmission line;

(b) a plurality of passive elements circumferentially-spaced around the driven element, each passive element including at least three antenna segments arranged in a substantially linear fashion and a pair of optoelectronic switches, the optoelectronic switches coupling pairs of the antenna segments to one another, each optoelectronic switch having a first, substantially conducting impedance state and a second, substantially non-conducting impedance state and being responsive to an optical activation signal such that when illuminated by the activation signal the optoelectronic switches are in one impedance state and absent illumination by the activation signal in the remaining impedance state;

(c) means for providing an optical activation signal to the optoelectronic switches.

14. An optically reconfigurable array antenna, comprising:

(a) a driven element that is couplable to a transmission line;

(b) a reflective element positioned adjacent the driven element;

(c) a director element positioned adjacent the driven element, opposite the reflector element, the director element, including at least three antenna segments arranged in a substantially linear fashion;

(d) a plurality of optoelectronic switches, a different one of the optoelectronic switches being coupled between adjacent pairs of the antenna segments of the director element, each optoelectronic switch having a first, substantially conducting impedance state and a second, substantially non-conducting impedance state, the optoelectronic switches being responsive to an optical activation signal such that the strength of the activation signal determines the impedance state of the optoelectronic switch; and (e) non-metallic means for providing an optical activation signal to the optoelectronic switches.

* * * * *

UNITED STATES PATENT AND TRADEMARK OFFICE

CERTIFICATE OF CORRECTION

PATENT NO. : 5,293,172

DATED : March 8, 1994

INVENTOR(S) : B. J. Lamberty et al.

It is certified that error appears in the above-indentified patent and that said Letters Patent is hereby corrected as shown below:

| COLUMN | LINE | |
|---|---|---|
| On the title page, item [56] "U.S. Patents" | 2nd Ref. | Please add --3,339,205 8/1967 Smitka-- |
| [56] "U.S. Patents" | 3rd Ref. | Please add --4,028,702 6/1977 Levine-- |
| [56] "U.S. Patents" | 4th Ref. | Please add --4,258,363 3/1981 Bodmer et al.-- |
| [56] "U.S. Patents" | 5th Ref. | Please add --4,686,533 8/1987 MacDonald et al.-- |
| [56] "U.S. Patents" | 6th Ref. | Please add --4,728,805 3/1988 Dempsey-- |
| [56] "U.S. Patents" | 7th Ref. | Please add --4,751,513 6/1988 Daryoush et al.-- |
| [56] "U.S. Patents" | 8th Ref. | Please add --4,855,749 8/1989 DeFonzo-- |
| [56] "Other Publn." | 1st Ref. | Please add --Dempsey et al., "The Synaptic Antenna For Reconfigurable Array Applications--Description," IEEE, pp. 760-763 (1989).-- |

UNITED STATES PATENT AND TRADEMARK OFFICE

CERTIFICATE OF CORRECTION

PATENT NO. : 5,293,172

DATED : March 8, 1994

INVENTOR(S) : B. J. Lamberty et al.

It is certified that error appears in the above-indentified patent and that said Letters Patent is hereby corrected as shown below:

| COLUMN | LINE | |
|---|---|---|
| [56] "Other | 2nd Ref. Publn." | Please add --Freeman et al., "Microwave Control Using a High-Gain Bias-Free Optoelectronic Switch," *Optical Technology for Microwave Applications V*, pp. 320-325 (1991)-- |

Signed and Sealed this

Sixth Day of December, 1994

Bruce Lehman

*Attest:*

BRUCE LEHMAN

*Attesting Officer*

*Commissioner of Patents and Trademarks*